US008725039B2

(12) United States Patent
Tanda

(10) Patent No.: US 8,725,039 B2
(45) Date of Patent: May 13, 2014

(54) FIXING DEVICE AND IMAGE FORMING APPARATUS WITH A COVER FOR GENERATING A STABLE NIPPING PRESSURE ON A CONVEYANCE ROLLER PAIR

(75) Inventor: Tetsuo Tanda, Osaka (JP)

(73) Assignee: Kyocera Mita Corporation (JP)

( * ) Notice: Subject to any disclaimer, the term of this patent is extended or adjusted under 35 U.S.C. 154(b) by 134 days.

(21) Appl. No.: 13/420,711

(22) Filed: Mar. 15, 2012

(65) Prior Publication Data

US 2012/0237259 A1 Sep. 20, 2012

(30) Foreign Application Priority Data

Mar. 16, 2011 (JP) ..... 2011-057759

(51) Int. Cl.
*G03G 15/20* (2006.01)

(52) U.S. Cl.
USPC ..... 399/122

(58) Field of Classification Search
USPC ..... 399/122, 124, 320, 328, 405
See application file for complete search history.

(56) References Cited

U.S. PATENT DOCUMENTS 4,571,056 A * 2/1986 Tani et al. ..... 399/122
2011/0229178 A1* 9/2011 Ogawa et al. ..... 399/67

FOREIGN PATENT DOCUMENTS

JP 56161562 A * 12/1981
JP 60-201361 10/1985
JP 03081792 A * 4/1991
JP 10186916 A * 7/1998
JP 2001-13810 1/2001
JP 2008-134409 6/2008
JP 2008-268401 11/2008

* cited by examiner

*Primary Examiner* — Robert Beatty

(74) *Attorney, Agent, or Firm* — Gerald E. Hespos; Michael J. Porco; Matthew T. Hespos

(57) ABSTRACT

A fixing device includes a housing, a cover member pivotally mounted on the housing, and operable to change the posture thereof between a closing posture and an opening posture, and a first and second urging member. A first conveyance roller for conveying a sheet is rotatably supported on the housing, and a second conveyance roller to be pressingly contacted with the first conveyance roller is rotatably supported on the cover member. The first urging member applies, to the cover member in the opening posture, an urging force for returning the cover member from the opening posture to an intermediate posture between the opening posture and the closing posture. The second urging member applies, to the second conveyance roller, an urging force with which the second conveyance roller is pressingly contacted with the first conveyance roller when the cover member is in the closing posture.

13 Claims, 6 Drawing Sheets

FIXING DEVICE AND IMAGE FORMING APPARATUS WITH A COVER FOR GENERATING A STABLE NIPPING PRESSURE ON A CONVEYANCE ROLLER PAIR

This application is based on Japanese Patent Application No. 2011-057759 filed on Mar. 16, 2011, the contents of which are hereby incorporated by reference.

BACKGROUND

The present disclosure relates to a fixing device for applying a fixing processing to a sheet carrying a transferred toner image, and an image forming apparatus incorporated with the fixing device.

A fixing device in an image forming apparatus is provided with a fixing roller and a pressing roller, and a toner image is fixed onto a sheet by allowing the sheet carrying the transferred toner image to pass a fixing nip portion formed by the fixing roller and the pressing roller for heating and pressurization. Generally, the fixing device is configured into a unit, and is detachably mounted on an image forming apparatus main body for maintenance service and the like. The fixing roller and the pressing roller are accommodated in a housing of the unit. Further, normally, a pair of conveyance rollers is disposed downstream of the fixing nip portion for feeding a sheet to a sheet discharge unit of the image forming apparatus main body, and the conveyance roller pair is also supported by the housing.

A sheet may be jammed in the housing of the fixing device. It is highly likely that a sheet may be jammed at a position between the fixing nip portion and the conveyance roller pair. Conventionally, there has been known a fixing device configured in such a manner that a part of a housing is formed into an openable and closable cover member so that a user is accessible to the fixing nip portion from the outside of the apparatus main body for allowing the user to remove the jammed sheet. In the fixing device, one of the conveyance roller pair is supported by the cover member. When the cover member is opened with respect to the housing for removing a jammed sheet, the fixing nip portion is exposed and at the same time, the nip portion of the conveyance roller pair is divided. Thus the user is allowed to easily remove the jammed sheet by opening the cover member.

A certain nipping pressure is required in the nip portion of the conveyance roller pair for giving a sheet conveying force. Further, generally, a torsion spring is mounted at a pivot portion of the cover member with respect to the housing to urge the cover member in a direction of returning the cover member from an opening posture that the cover member is opened with respect to the housing to a closing posture that the cover member is closed with respect to the housing. In the conventional fixing device, the nipping pressure of the conveyance roller pair is generated, utilizing an urging force of the torsion spring.

In the structure as described above, the nipping pressure of the conveyance roller pair may be unstable. One of the reasons of the drawback is that the torsion spring is an urging member disposed for the purpose of returning the cover member to the original posture, and therefore, it is difficult to generate a stable nipping pressure in the axis direction of the conveyance roller pair without variation. Further, the torsion spring has two functions i.e. a function of returning the cover member from an opening posture to a closing posture, and a function of generating a nipping pressure in the conveyance roller pair when the cover member is in the closing posture. In view of the above, it is necessary to use a torsion spring having a relatively large urging force. Consequently, an unduly large urging force may be applied to the cover member, and large impact noise may be generated resulting from such an unduly large urging force, when the cover member is closed. In a worse case, a part of the cover member may be damaged or broken.

In view of the above drawbacks, it is an object of the present disclosure to provide a fixing device having a cover member, which is capable of stably generating a nipping pressure of a conveyance roller pair, while preventing generation of impact noise.

SUMMARY

A fixing device according to an aspect of the present disclosure includes a first roller and second roller, a housing, a cover member, a first and second conveyance roller, and a first and second urging member. The first roller and the second roller form a fixing nip portion for applying a fixing processing to a sheet. The housing accommodates the first roller and the second roller, and has an opening through which the fixing nip portion is exposed. The cover member is pivotally mounted on the housing, and is operable to change a posture thereof between a closing posture that the opening is covered, and an opening posture that the opening is opened. The first conveyance roller is rotatably supported on the housing, and conveyances the sheet that has passed the fixing nip portion. The second conveyance roller is rotatably supported on the cover member, and is pressingly contacted with the first conveyance roller when the cover member is in the closing posture. The first urging member applies, to the cover member in the opening posture, an urging force for returning the cover member from the opening posture to an intermediate posture between the opening posture and the closing posture. The second urging member applies, to the second conveyance roller, an urging force with which the second conveyance roller is pressingly contacted with the first conveyance roller when the cover member is in the closing posture.

An image forming apparatus according to another aspect of the present disclosure includes an image forming section, a fixing device, an apparatus body and a main body cover. The image forming section forms a toner image onto a sheet. The fixing device applies a processing of fixing the toner image to the sheet. The apparatus body includes a casing structure, and accommodates the image forming section and the fixing device. The main body cover is mounted on the apparatus body to be openable and closable. The fixing device has the aforementioned arrangement.

These and other objects, features and advantages of the present disclosure will become more apparent upon reading the following detailed description along with the accompanying drawings.

DETAILED DESCRIPTION

Figure 1:
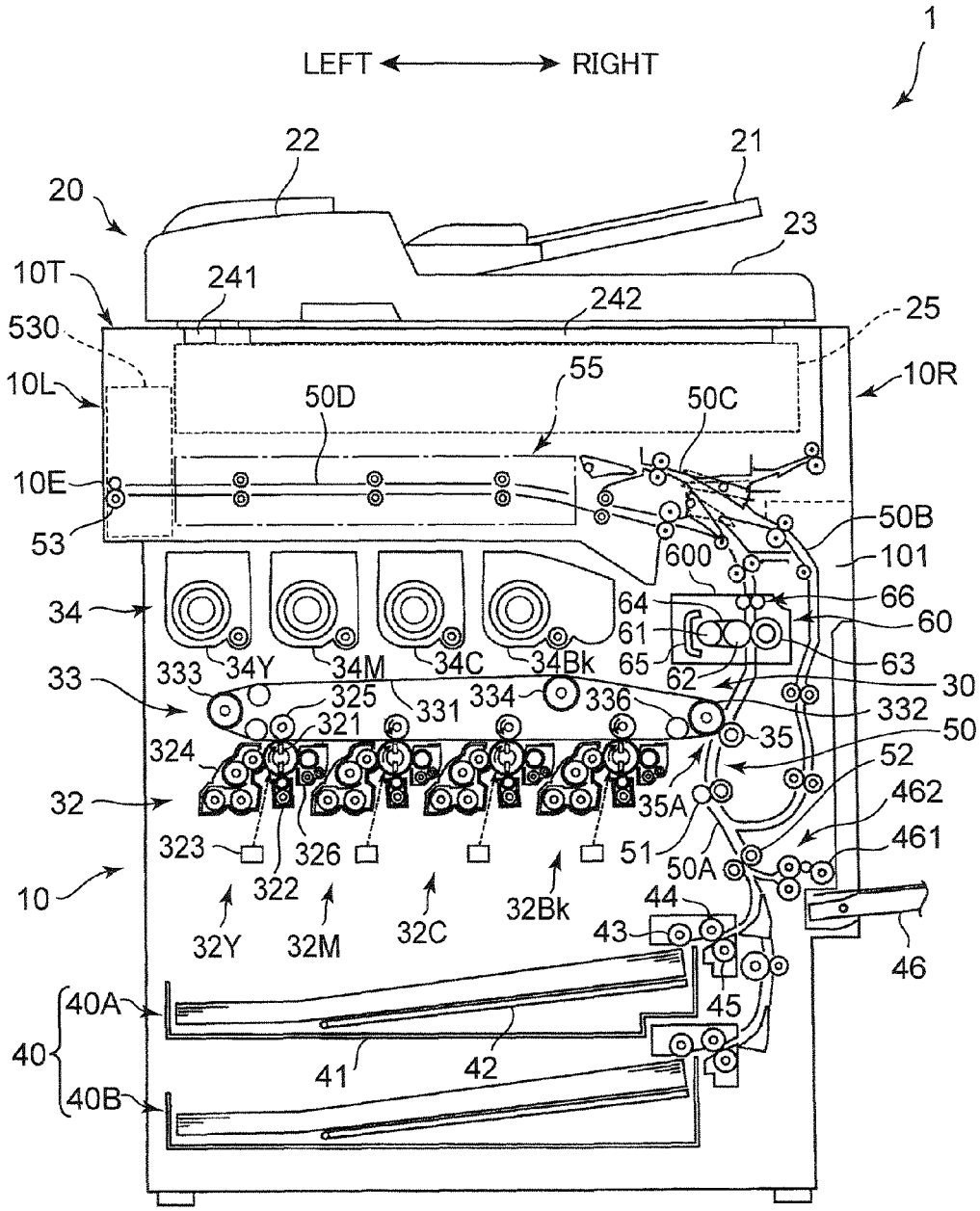
FIG. 1 is a cross-sectional view showing an internal structure of an image forming apparatus embodying the present disclosure.

In the following, an embodiment of the present disclosure is described referring to the drawings. FIG. 1 is a cross-sectional view showing an internal structure of an image forming apparatus 1 embodying the present disclosure. In this example, the image forming apparatus 1 is a copying machine. Alternatively, the image forming apparatus may be a printer, a facsimile device, or a complex machine provided with the functions of these devices.

The image forming apparatus 1 is provided with an apparatus body 10 having a substantially rectangular parallelepiped casing structure, and an automatic document feeder 20 to be disposed on the apparatus body 10. The apparatus body 10 is internally provided with a reading unit 25 for optically reading a document image to be copied, an image forming section 30 for forming a toner image onto a sheet, a fixing section 60 (a fixing device) for fixing the toner image onto the sheet, a sheet feeding section 40 for storing sheets to be conveyed to the image forming section 30, a conveyance path 50 for conveying the sheets one by one from the sheet feeding section 40 to a sheet discharge port 10E via the image forming section 30 and the fixing section 60, and a conveyance unit 55 internally formed with a sheet conveyance path constituting a part of the conveyance path 50.

Figure 4:
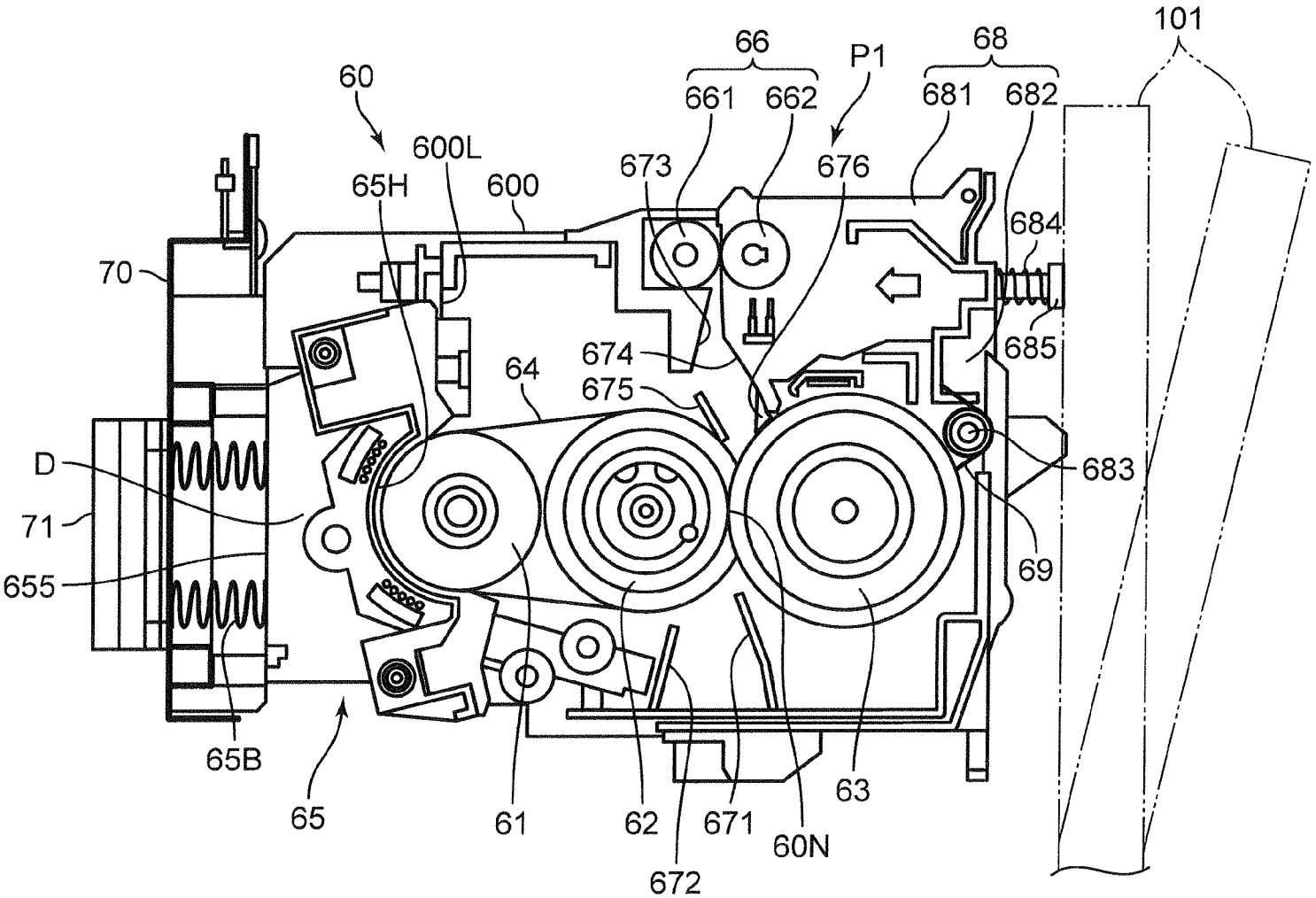
FIG. 4 is a cross-sectional view of the fixing device, specifically, a diagram showing a state that the cover member is in a closing posture.

A right side surface 10R (one side surface of the apparatus body) of the apparatus body 10 is formed with a main body cover 101 which is opened and closed in detaching a unit such as the image forming section 30 and the fixing section 60 from the apparatus body 10 for removing a jammed sheet or for maintenance service. The main body cover 101, shown in FIG. 4, is pivotally mounted on the apparatus body 10 about a base end thereof (a lower end of the main body cover 101).

The automatic document feeder 20 is pivotally mounted on a top surface of the apparatus body 10. The automatic document feeder 20 automatically feeds a document sheet to be copied toward a predetermined document reading position (a mounted position of a first contact glass 241) of the apparatus body 10. When the user manually places a document sheet or sheets onto a predetermined document reading position (a disposed position of a second contact glass 242), the automatic document feeder 20 is opened upward. The automatic document feeder 20 includes a document tray 21 on which a document sheet or sheets are placed, a document conveyance section 22 for conveying the document sheet(s) via the automatic document reading position, and a document discharge tray 23 on which the document sheet(s) after image reading are discharged.

The reading unit 25 optically reads an image of a document sheet through the first contact glass 241 for reading an image of a document sheet to be automatically fed from the automatic document feeder 20 disposed on the top surface of the apparatus body 10, or through the second contact glass 242 for reading an image of a document sheet to be placed manually by the user. The reading unit 25 houses therein a scanning mechanism including a light source, a moving carriage, and a reflection mirror; and an image sensor, all of which are not shown. The scanning mechanism irradiates light onto a document sheet, and guides the light reflected on the document sheet to the image sensor. The image sensor photoelectrically converts the reflected light into an analog electric signal. The analog electric signal is converted into a digital electric signal by an A/D conversion circuit, and then, is inputted to the image forming section 30.

The image forming section 30 is adapted to perform a processing of generating a full-color toner image and transferring the toner image onto a sheet, and includes an image forming unit 32 having tandemly-arranged four units 32Y, 32M, 32C, and 32Bk for respectively forming toner images of yellow (Y), magenta (M), cyan (C) and black (Bk), an intermediate transfer unit 33 disposed adjacent to and above the image forming unit 32, and a toner replenishing section 34 disposed above the intermediate transfer unit 33.

Each of the image forming units 32Y, 32M, 32C, and 32Bk includes a photosensitive drum 321; and a charger 322, an exposure device 323, a developing device 324, a primary transfer roller 325 and a cleaning device 326, which are disposed in the periphery of the photosensitive drum 321.

The photosensitive drum 321 rotates about the axis thereof, and forms an electrostatic latent image and a toner image on the circumferential surface thereof. An example of the photosensitive drum 321 is a photosensitive drum using an amorphous silicon (a-Si)-based material. The charger 322 uniformly charges the surface of the photosensitive drum 321. The exposure device 323 has a laser light source and an optical device such as a mirror and a lens, and forms an electrostatic latent image on the circumferential surface of the photosensitive drum 321 by irradiating light derived from image data of a document image.

The developing device 324 supplies toner to the circumferential surface of the photosensitive drum 321 for developing an electrostatic latent image formed on the photosensitive drum 321. The developing device 324 is adapted for supplying a two-component developer, and includes an agitation roller, a magnetic roller, and a developing roller. The agitation roller circulates and transports a two-component developer while agitating the two-component developer to thereby charge the toner. A two-component developer layer is deposited on the circumferential surface of the magnetic roller, and a toner layer formed by transferring the toner by an electric potential difference between the magnetic roller and the developing roller is deposited on the circumferential surface of the developing roller. The toner on the developing roller is supplied to the circumferential surface of the photosensitive drum 321, whereby the electrostatic latent image is developed.

The primary transfer roller 325 forms a nip portion with the photosensitive drum 321, with an intermediate transfer belt 331 provided in the intermediate transfer unit 33 being interposed, for primarily transferring a toner image on the photosensitive drum 321 onto the intermediate transfer belt 331. The cleaning device 326 has a cleaning roller, and cleans the circumferential surface of the photosensitive drum 321 after toner image transfer.

The intermediate transfer unit 33 is provided with the intermediate transfer belt 331, a drive roller 332, a driven roller 333, a tension roller 334 and a backup roller 336. The intermediate transfer belt 331 is an endless belt which is wound around the rollers 332, 333, 334, 336; and toner images are transferred one over the other at a certain position on the outer circumferential surface of the intermediate transfer belt 331 from the plurality of photosensitive drums 321 (primary transfer).

The drive roller 332 is a roller formed by molding a sponge-like electrically conductive rubber into a cylindrical shape on an electrically conductive shaft made of a metal, and a driving force for circulating the intermediate transfer belt 331 is given to the drive roller 332. A secondary transfer roller 35 is disposed at a position opposite to the circumferential surface of the drive roller 332. The secondary transfer roller 35 is also an electrically conductive roller. A nip portion between the drive roller 332 and the secondary transfer roller 35 serves as a secondary transfer section 35A for transferring a full-color toner image obtained by laying the color toner images one over the other on the intermediate transfer belt 331 onto a sheet.

A secondary transfer bias potential having a polarity opposite to the polarity of the toner image is applied to either one of the drive roller 332 and the secondary transfer roller 35, and the other of the drive roller 332 and the secondary transfer roller 35 is grounded. The driven roller 333 is a roller that is driven in accordance with the circulation of the intermediate transfer belt 331, the tension roller 334 is a roller for giving a predetermined tension force to the intermediate transfer belt 331, and the backup roller 336 is a roller that is disposed immediately upstream of the secondary transfer section 35A in the circulating direction of the intermediate transfer belt 331, and is adapted to bend the intermediate transfer belt 331.

The toner replenishing section 34 includes a yellow toner container 34Y, a magenta toner container 34M, a cyan toner container 34C, and a black toner container 34Bk. These toner containers 34Y, 34C, 34M, 34Bk respectively store toners of the corresponding colors, and supply the toners of the corresponding colors to the developing devices 324 of the image forming units 32Y, 32M, 32C, 32Bk respectively corresponding to the colors of YMCBk through an unillustrated supply route.

The sheet feeding section 40 is provided with two sheet cassettes 40A, 40B which are stacked one over the other for storing sheets for image formation therein. The sheet cassettes 40A, 40B are withdrawable in a forward direction from the front side of the apparatus body 10. The sheet cassettes 40A, 40B are cassettes designed for automatic sheet feeding, and a sheet feeding tray 46 for manual feeding is provided on the right side surface 10R of the apparatus body 10. The sheet feeding tray 46 is mounted on the main body cover 101 at a lower end of the sheet feeding tray 46 to be openable and closable. When a sheet or sheets are manually fed, the user opens the sheet feeding tray 46 as illustrated in FIG. 1, and places the sheet(s) on the sheet feeding tray 46.

The sheet cassette 40A (40B) is provided with a sheet storage section 41 for storing a sheet stack constituted of a stack of sheets, and a lifting plate 42 for lifting the sheet stack for sheet feeding. A pickup roller 43, and a pair of rollers constituted of a sheet feeding roller 44 and a retard roller 45 are disposed at an upper position on the right end side of the sheet cassette 40A (40B). By driving the pickup roller 43 and the sheet feeding roller 44, the sheets of the sheet stack in the sheet cassette 40A are dispensed one by one from an uppermost sheet thereof, and are conveyed to the upstream end of the conveyance path 50. On the other hand, the sheets placed on the sheet feeding tray 46 are conveyed into the conveyance path 50 by driving a pickup roller 461 and a sheet feeding roller 462.

The conveyance path 50 includes a main conveyance path 50A for conveying a sheet from the sheet feeding section 40 to the exit of the fixing section 60 via the image forming section 30; a reverse conveyance path 50B for returning a sheet after a one-side printing to the image forming section 30 for performing a double-sided printing for the sheet; a switch-back conveyance path 50C for directing a sheet from the downstream end of the main conveyance path 50A to the upstream end of the reverse conveyance path 50B; and a horizontal conveyance path 50D for horizontally conveying a sheet from the downstream end of the main conveyance path 50A to the sheet discharge port 10E formed in a left side surface 10L of the apparatus body 10. A main part of the horizontal conveyance path 50D is constituted of a sheet conveyance path formed in the conveyance unit 55.

A registration roller pair 51 is disposed upstream of the main conveyance path 50A with respect to the secondary transport section 35A. Conveyance of a sheet is temporarily stopped by the registration roller pair 51 in a stopped state, and skew correction is performed for the sheet. Thereafter, the sheet is fed to the secondary transport section 35A at a predetermined timing for image transfer by driving and rotating a drive motor (not shown) by the registration roller pair 51. A plurality of conveyance rollers 52 for conveying a sheet are disposed in the main conveyance path 50A, in addition to the above-mentioned rollers. The same arrangement as described above is applied to the conveyance paths 50B, 50C, 50D.

A sheet discharge unit 530 provided with a sheet discharge roller 53 is disposed at a most downstream end of the conveyance path 50 at a position adjacent to the conveyance unit 55. The sheet discharge roller 53 feeds a sheet to an unillustrated post-processing device disposed on the left side surface 10L of the apparatus body 10 through the sheet discharge port 10E. In the case where a post-processing device is not mounted on the image forming apparatus, a sheet discharge tray is disposed at a position below the sheet discharge port 10E.

The conveyance unit 55 is a unit for conveying a sheet to be outputted from the fixing section 60 to the sheet discharge port 10E. The image forming apparatus 1 of the embodiment is constructed in such a manner that the fixing section 60 is disposed on the side of the right side surface 10R of the apparatus body 10, and the sheet discharge port 10E is disposed on the side of the left side surface 10L of the apparatus body 10 facing the right side surface 10R. With this arrangement, the conveyance unit 55 horizontally conveys a sheet from the right side surface 10R of the apparatus body 10 toward the left side surface 10L of the apparatus body 10.

The fixing section 60 is an inductive heating type fixing device for applying a fixing processing of fixing a toner image onto a sheet, and includes a heating roller 61, a fixing roller 62 (a second roller), a pressing roller 63 (a first roller), a fixing belt 64, an inductive heating unit 65 and a conveyance roller pair 66. The aforementioned elements other than the inductive heating unit 65 are accommodated in a housing 600 and are configured into a unit (a fixing unit), and thus the fixing unit is detachably mounted on the apparatus body 10. On the other hand, the inductive heating unit 65 is mounted on a body frame 70 of the apparatus body 10. With this arrangement, in the case where the inductive heating unit 65 is normally operated in a condition that the fixing unit is required to be exchanged resulting from aging deterioration or the like, it is possible to exchange only the fixing unit, while continuing use of the inductive heating unit 65.

Figure 2:
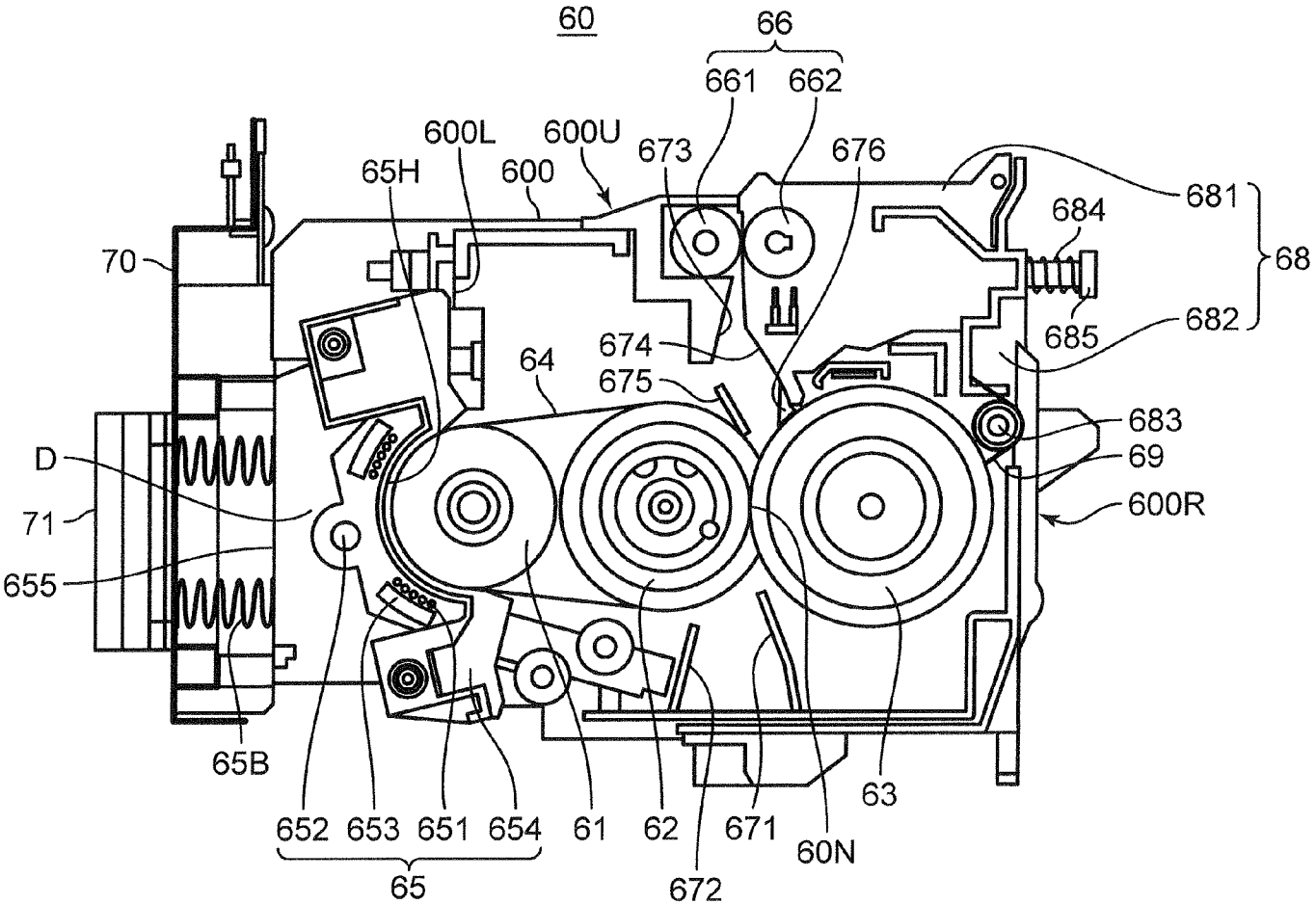
FIG. 2 is a cross-sectional view showing an internal structure of a fixing device embodying the present disclosure.

FIG. 2 is a cross-sectional view showing an internal structure of the fixing section 60. In the following, a detailed structure of the fixing section 60 is described referring to FIG. 2. The heating roller 61 is a roller which is inductively heated by the inductive heating unit 65. The heating roller 61 is made of a magnetic metal such as iron or stainless steel, and a releasing layer made of e.g. a PFA resin is formed on the surface of the heating roller 61.

The fixing roller 62 and the pressing roller 63 have the circumferential surfaces thereof being pressed against each other, with the fixing belt 64 being interposed therebetween. The fixing roller 62 and the pressing roller 63 are rollers for forming a fixing nip portion 60N. A sheet to which a toner image has been transferred by secondary transfer in the secondary transfer section 35A is allowed to pass the fixing nip portion 60N, and undergoes heating and pressurization, whereby the toner image is fixed onto the sheet surface. The fixing roller 62 is an elastic roller having an elastic layer made of a silicon sponge as the outer layer thereof. The pressing roller 63 is a roller having a hardness larger than the hardness of the fixing roller 62, and is internally provided with a heating element such as a halogen heater. A preferred example of the pressing roller 63 is a roller comprised of a core member made of a metal such as iron or aluminium, a silicon rubber layer formed on the core member, and a fluorine resin layer formed on the surface of the silicon rubber layer.

The fixing belt 64 is a belt which is wound around the heating roller 61 and the fixing roller 62, and is inductively heated by the inductive heating unit 65 in the same manner as the heating roller 61. The fixing belt 64 is formed by e.g. placing a silicon rubber elastic layer and a PFA resin releasing layer one over the other on a base member made of a ferromagnetic material such as nickel. In the case where the fixing belt 64 is simply used as a carrier of heat generated by the heating roller 61 without imparting a heated function to the fixing belt 64, it is possible to use a resin belt made of e.g. a PI (polyimide) resin.

The rotary shaft of the pressing roller 63 is rotatably supported by a fixed frame in the housing 600. On the other hand, the rotary shafts of the heating roller 61 and the fixing roller 62 are rotatably supported by a movable frame in the housing 600. A belt unit including the heating roller 61, the fixing roller 62 and the fixing belt 64 is operable to change a posture thereof, by an unillustrated nipping pressure adjusting mechanism, between a normal pressurized posture that the circumferential surface of the fixing roller 62 is pressingly contacted with the circumferential surface of the pressing roller 63 with a relatively large nipping pressure, and a depressurized posture that the circumferential surface of the fixing roller 62 is pressingly contacted with the circumferential surface of the pressing roller 63 with a relatively small nipping pressure. A rotational driving force is inputted from a motor disposed on the side of the apparatus body 10 to the rotary shaft of the pressing roller 63 via a predetermined speed reducing mechanism. The heating roller 61, the fixing roller 62 and the fixing belt 64 are driven along with the rotation of the pressing roller 63.

The inductive heating unit 65 is provided with an inductive heating coil 651, a center core 652, a pair of arch cores 653 and a unit housing 654 for accommodating these members. The inductive heating coil 651 generates a magnetic field for inductively heating the heating roller 61 and the fixing belt 64, and is disposed on an imaginary arc plane opposite to the arc plane defined by the heating roller 61 and the fixing belt 64. The center core 652 and the paired arch cores 653 are each a core made of ferrite, and are disposed for forming a magnetic path passing a part of the heating roller 61 and the fixing belt 64. With this arrangement, an eddy current is generated in the heating roller 61 and the fixing belt 64, and a heat resulting from a Joule heat is generated accompanied by the generation of an eddy current.

The unit housing 654 is formed with an arc-shaped recess portion 65H in which a part of the heating roller 61 and the fixing belt 64 is received. The unit housing 654 of the inductive heating unit 65, and a left side surface 600L of the housing 600 of the fixing unit are engaged with each other in a positioned state, and a gap of a predetermined interval is formed between the inner surface of the recess portion 65H and the outer surface of the fixing belt 64.

A duct member 655 is mounted on the back surface of the unit housing 654. A coil spring 65B is disposed between the body frame 70 and the back surface of the duct member 655. The coil spring 65B is disposed to urge the unit housing 654 toward the housing 600 for keeping the gap at a constant value. A space D through which cooling air is allowed to pass is formed in the inside of the duct member 655. Cooling air is drawn into the space D through a main body cooling duct 71 formed on the side of the apparatus body 10 for cooling the inductive heating unit 65.

The conveyance roller pair 66 is a pair of conveyance rollers for feeding a sheet that has passed the fixing nip portion 60N to a sheet conveyance path downstream of the housing 600. The conveyance roller pair 66 is constituted of a first conveyance roller 661 which is rotatably supported on the housing 600, and a second conveyance roller 662 which is rotatably supported on a cover member 68 to be described later. The first conveyance roller 661 is a drive roller to which a rotational driving force is inputted from the side of the apparatus body 10, and the second conveyance roller 662 is a driven roller that is rotated accompanied by rotation of the first conveyance roller 661. Further, the second conveyance roller 662 is pressingly contacted with the first conveyance roller 661 with a predetermined nipping pressure for giving a sheet conveying force.

There are disposed a pair of guide members 671, 672 upstream of the fixing nip portion 60N in the sheet conveyance direction for guiding a sheet to be fed toward the fixing nip portion 60N. Further, there are disposed a pair of guide members 673, 674 downstream of the fixing nip portion 60N for guiding a sheet to be discharged from the fixing nip portion 60N to the conveyance roller pair 66.

Referring to FIG. 2, the fixing roller 62 and the fixing belt 64 are rotated counterclockwise, and the pressing roller 63 is rotated clockwise. At the downstream of the fixing nip portion 60N in the rotating direction, a separation plate 675 is disposed as opposed to the circumferential surface of the fixing belt 64, and a separation pawl 676 is disposed as opposed to the circumferential surface of the pressing roller 63. The separation plate 675 and the separation pawl 676 are disposed to separate a sheet wound around the fixing belt 64 or the circumferential surface of the pressing roller 63 therefrom. The separation plate 675 is a plate-like member extending in the axis direction of the fixing roller 62, and a very small clearance is defined between the tip end of the separation plate 675 and the circumferential surface of the fixing belt 64. On the other hand, the separation pawl 676 is a member having a width thereof in the axis direction of the pressing roller 63 in the range of about several millimeters. The tip end of the separation pawl 676 is abutted against the circumferential surface of the pressing roller 63. Whereas the separation plate 675 is a single plate member having a length substantially equal to the width of plain paper, a plurality of separation pawls 676 are disposed with a certain interval in the axis direction of the pressing roller 63.

Figure 3:
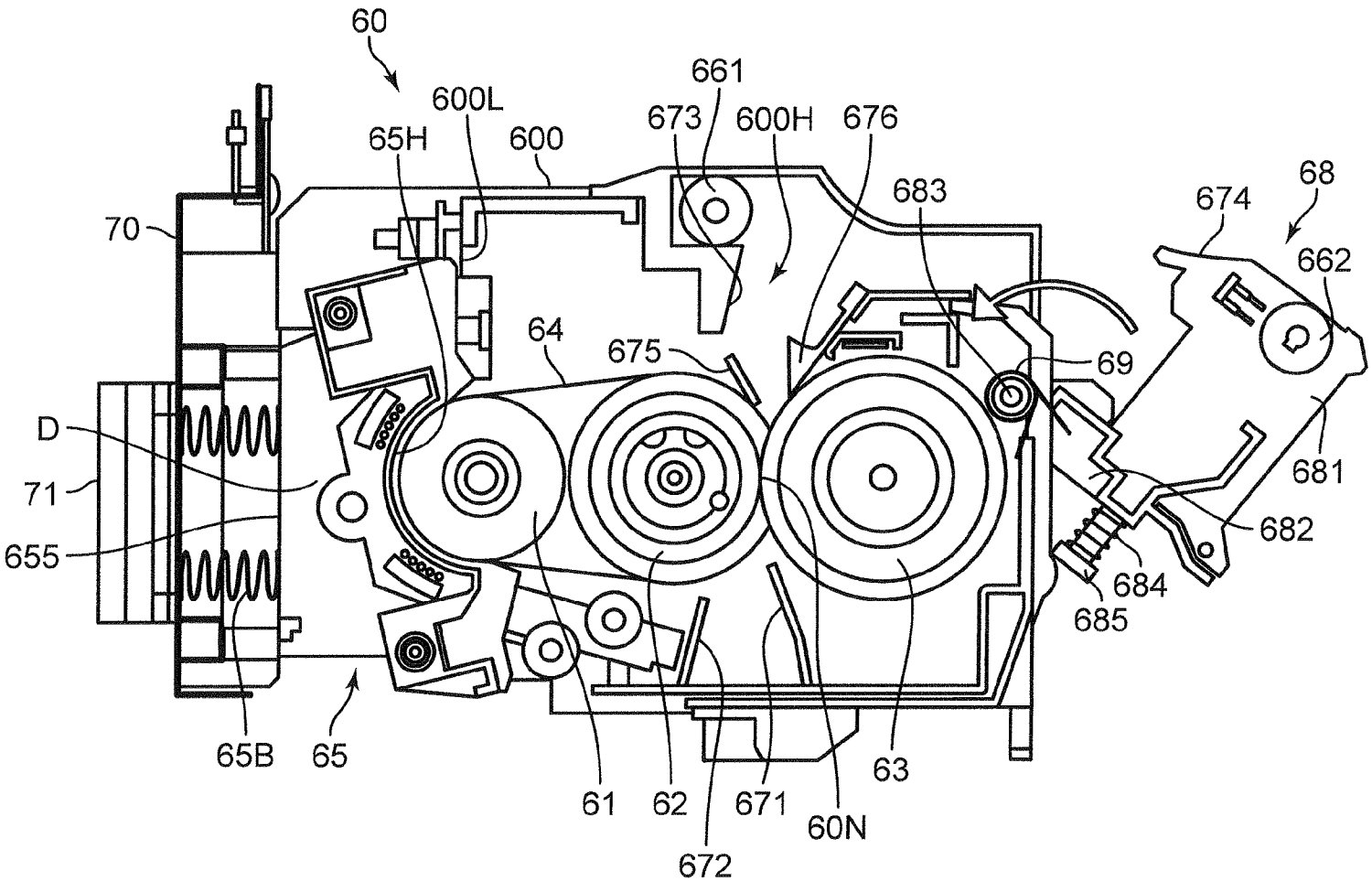
FIG. 3 is a cross-sectional view of the fixing device, specifically, a diagram showing a state that a cover member is in an opening posture.

The housing 600 has a generally rectangular shape in cross section, and an upper right corner portion of the housing 600 is covered by the openable and closable cover member 68. FIG. 3 shows a state that the cover member 68 is opened with respect to the housing 600. A top surface 600U and a right side surface 600R (one side surface) of the housing 600 at a position corresponding to the upper right corner portion are partially cut away into an opening 600H. When the cover member 68 does not cover the opening 600H, the fixing nip portion 60N is exposed to the outside of the apparatus body 10 through the opening 600H. The cover member 68 is a member for covering the opening 600H. In the above arrangement, since the cover member 68 is opened in the upward direction of the housing 600, impact noise is likely to be generated when the cover member 68 is closed. Therefore, the advantage by applying the present disclosure is significantly large.

The cover member 68 includes a cover body 681, an arm member 682 formed with a pivot portion 683, and a compression coil spring 684 (a second urging member). The cover body 681 includes a holding portion for pivotally holding the second conveyance roller 662 about the axis thereof, and a surface serving as the guide member 674. The arm member 682 is a rod-like member, with one end thereof having the pivot portion 683, and the other end thereof continuing to the cover member 68. The cover member 68 is connected to a support portion formed on the right side surface 600R of the housing 600 to be pivotally movable about the pivot portion 683.

Specifically, the cover member 68 is operable to change the posture thereof between a closing posture (see FIG. 2) that the opening 600H is covered, and an opening posture (see FIG. 3) that the opening 600H is opened by pivotally moving the cover member 68 about the axis of the pivot portion 683. Observing the posture of the arm member 682, the arm member 682 stands upright along the right side surface 600R of the housing 600 when the cover member 68 is in the closing posture, and is inclined in such a manner as to project outwardly from the right side surface 600R when the cover member 68 is in the opening posture. In the embodiment, there is described an example, in which the arm member 682 is pivotally moved from the closing posture about the axis of the pivot portion 683 by about 140 degrees, and the opening 600H is opened largely to such an extent that the guide member 674 is completely detached from the right side surface 600R when the cover member 68 is in the opening posture. The cover member 68 is constantly kept in a closing posture. However, the cover member 68 is brought to an opening posture when a sheet has jammed near the fixing nip portion 60N or for maintenance service. Since the second conveyance roller 662 is supported on the cover body 681, the second conveyance roller 662 is detached from the first conveyance roller 661 when the cover member 68 is brought to the opening posture. Thus, the nipping by the conveyance roller pair 66 is released.

A torsion coil spring 69 (a first urging member) is inserted in the pivot portion 683. The torsion coil spring 69 is a spring for urging the cover member 68 in the opening posture in a direction to return the cover member 68 to the closing posture. The torsion coil spring 69 does not have an urging force capable of completely returning the cover member 68 from the opening posture to the closing posture. This means that the torsion coil spring 69 does not substantially contribute to generation of a nipping pressure of the conveyance roller pair 66. This will be described later in detail.

The compression coil spring 684 is a spring which applies, to the second conveyance roller 662, an urging force with which the second conveyance roller 662 is pressingly contacted with the first conveyance roller 661 when the cover member 68 is in the closing posture. The compression coil spring 684 is received in a movable pin 685 (a pressed member) in engagement therewith. The movable pin 685 has a bolt-like shape with a bolt head and a stem, has a locking mechanism, and is mounted on the cover body 681 to be slidably movable. The compression coil spring 684 is received in the stem of the movable pin 685, with one end thereof being abutted against the bolt head, and the other end thereof being abutted against an appropriate position of the cover body 681.

The movable pin 685 is pressed by the right side surface 10R of the apparatus body 10, in other words, by the main body cover 101 provided on a side surface of the apparatus body 10 where the fixing section 60 is disposed, when the cover member 68 is in a closing posture. FIG. 4 is a diagram schematically showing a state that the bolt head of the movable pin 685 is pressed by the main body cover 101. The movable pin 685 is not subjected to pressing force in a state (shown by the one-dotted chain line in FIG. 4) that the main body cover 101 is opened with respect to the apparatus body 10. In this state, the cover member 68 is in a closing posture, and the second conveyance roller 662 is not in a pressing contact state, although the second conveyance roller 662 is contacted with the first conveyance roller 661.

On the other hand, when the main body cover 101 is brought to a closed state with respect to the apparatus body 10, the movable pin 685 is pressed against the inner surface of the main body cover 101. By the application of the pressing force, the movable pin 685 is slidably moved in a direction toward the conveyance roller pair 66, whereby the compression coil spring 684 is compressed. As a result of this operation, an urging force is generated in the compression coil spring 684, and as shown by the arrow in FIG. 4, the cover member 68 is urged in the direction toward the left side surface 600L of the housing 600. As the cover member 68 is urged, the second conveyance roller 662 is brought to a state that the second conveyance roller 662 is pressingly contacted with the first conveyance roller 661, whereby a predetermined nipping pressure required for sheet conveyance is given to the conveyance roller pair 66.

Figure 5:
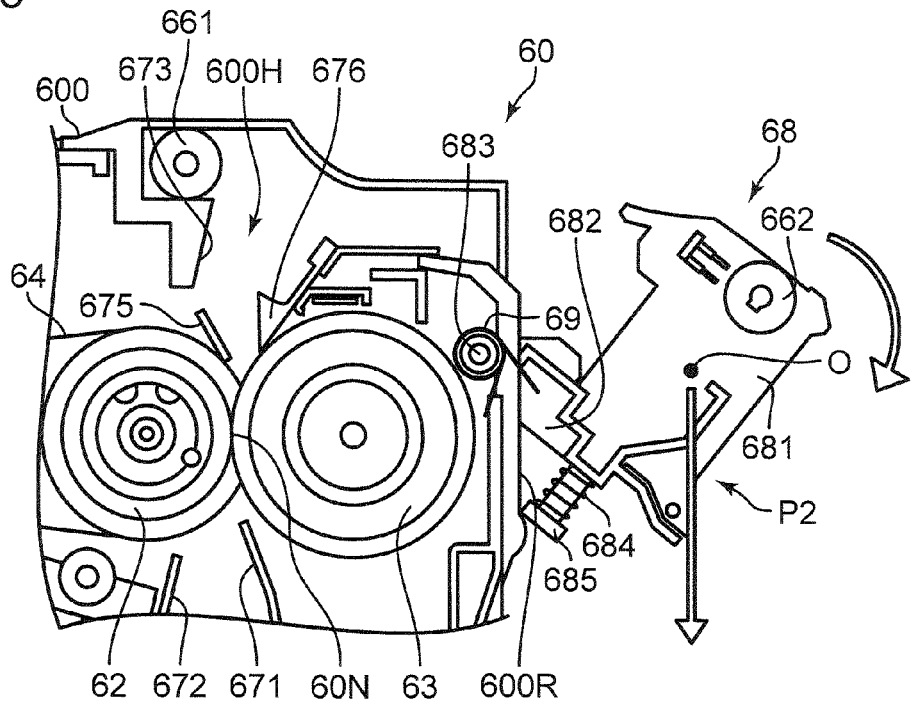
FIG. 5 is a diagram for describing an operation as to how the cover member is opened and closed, specifically, a diagram showing a state that the cover member is in the opening posture.

Subsequently, referring to FIGS. 5 through 8, a posture change of the cover member 68 from an opening posture to a closing posture is described in detail. FIG. 5 is a diagram showing a state that the cover member 68 is in an opening posture, FIG. 6 is a diagram showing a state that the cover member 68 is an intermediate posture, FIG. 7 is a diagram showing a state that the cover member 68 is in an upright posture, and FIG. 8 is a diagram showing a state that the cover member 68 is in a closing posture.

Referring to FIG. 5, when the cover member 68 is in an opening posture, the torsion coil spring 69 generates an urging force for returning the cover member 68 to the closing posture about the axis of the pivot portion 683. In other words, the torsion coil spring 69 generates an urging force to restrict the cover member 68 from pivotally moving about the axis of the pivot portion 683 clockwise in FIG. 5 by the weight of the cover member 68. When the cover member 68 is in the opening posture, the centroid O of the cover member 68 is located at a position greatly outward from the right side surface 600R of the housing 600.

Figure 6:
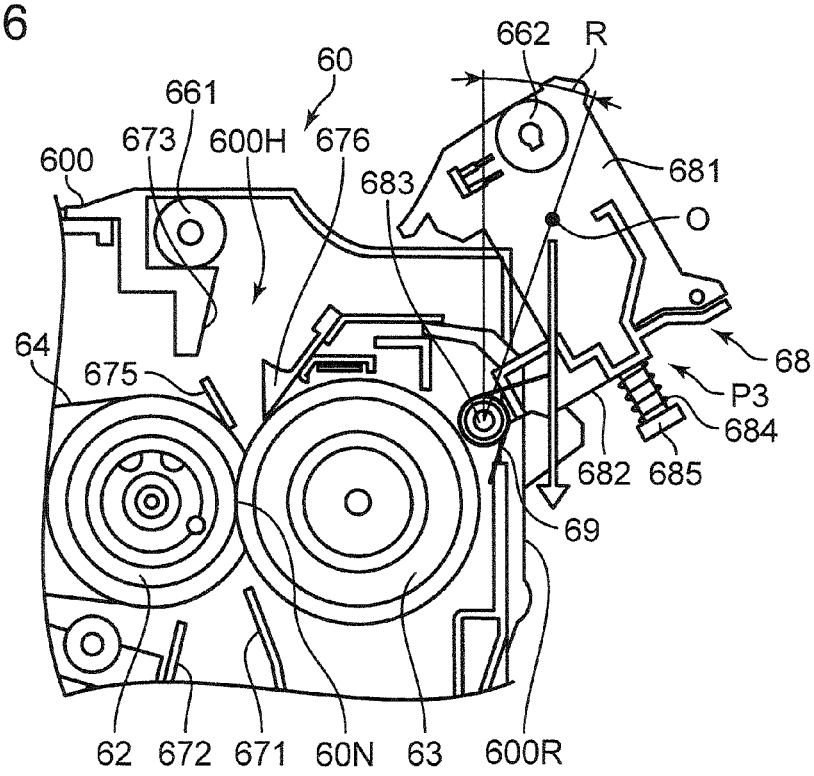
FIG. 6 is a diagram showing a state that the cover member is in an intermediate posture.

The intermediate posture shown in FIG. 6 is a posture between the closing posture and the opening posture, and a posture that the urging force of the torsion coil spring 69 is minimally applied to the cover member 68. Specifically, the urging force generated in the torsion coil spring 69 becomes zero when the cover member 68 comes close to the closing posture from the intermediate posture, and after the urging force becomes zero, the torsion coil spring 69 is brought to a state incapable of urging the cover member 68. When the cover member 68 is in the intermediate posture, the centroid O of the cover member 68 is located at such a position that the cover member 68 is pivotally moved clockwise about the axis of the pivot portion 683 by a predetermined angle R with respect to a position immediately above the pivot portion 683. The predetermined angle R is preferably in the range of from about 10 to 30 degrees.

Figure 7:
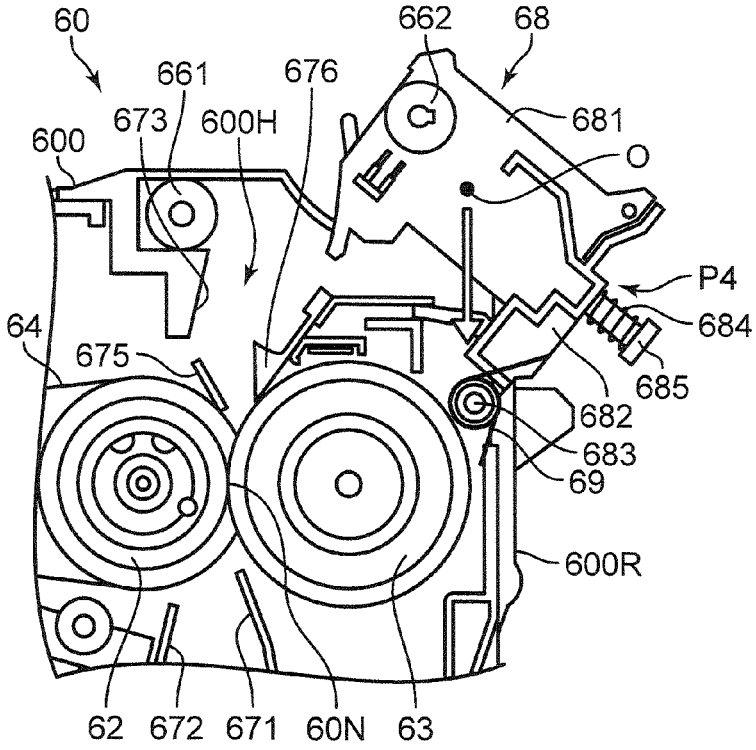
FIG. 7 is a diagram showing a state that the cover member is in an upright posture.
Figure 8:
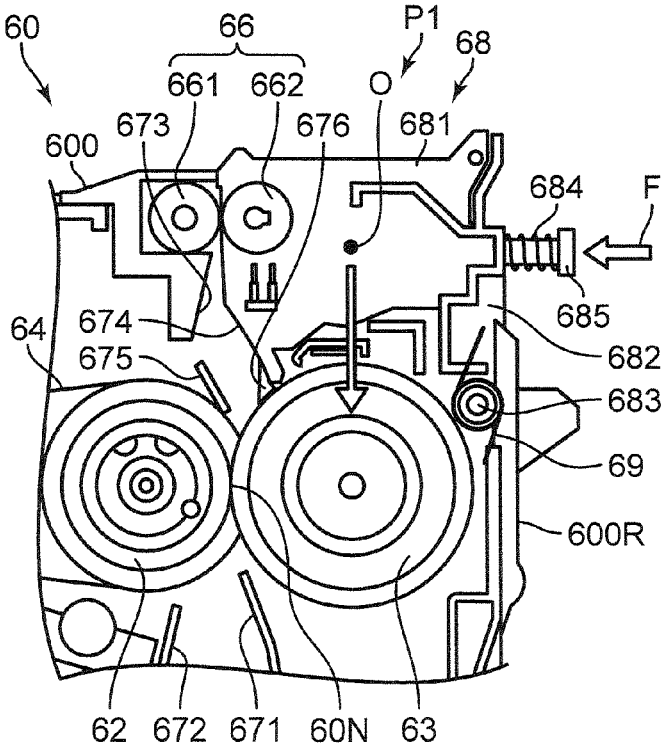
FIG. 8 is a diagram showing a state that the cover member is in the closing posture.

The upright posture shown in FIG. 7 is a posture that the cover member 68 comes close to the closing posture from the intermediate posture shown in FIG. 6, and is a posture that the centroid O of the cover member 68 is located at the position immediately above the pivot portion 683. When the cover member 68 is in the upright posture, the urging force of the torsion coil spring 69 is no longer applied, and a pivot movement of the cover member 68 toward the closing posture thereafter is attained by a manual operation of the user or by the weight of the cover member 68. When the centroid P of the cover member 68 reaches an inner position with respect to the position immediately above the pivot portion 683, the cover member 68 naturally returns to the closing posture by the weight of the cover member 68. Therefore, if the cover member 68 is in a state that the urging force of the torsion coil spring 69 is continued to be applied to the cover member 68 even in the upright posture shown in FIG. 7, the cover member 68 may be pivotally moved from the opening posture to the closing posture without any transition. However, the embodiment is configured in such a manner that the centroid O of the cover member 68 is located outwardly from the position immediately above the pivot portion 683 when the urging force of the torsion coil spring 69 is no longer applied to the cover member 68. Accordingly, the pivotal movement of the cover member 68 is temporarily suspended when the cover member 68 is in the intermediate posture. Thus, there is no likelihood that the cover member 68 may be vigorously closed.

When the cover member 68 is in the closing posture shown in FIG. 8, the opening 600H of the housing 600 is completely covered, and the centroid O of the cover member 68 is located near the position immediately above the pressing roller 63. As described above, in a state that the main body cover 101 is not closed although the cover member 68 is in the closing posture, the second conveyance roller 662 held on the cover body 681 is contacted with the first conveyance roller 661 held on the side of the housing 600. However, in this state, only the weight of the cover body 681 is exerted on the second conveyance roller 662. Accordingly, a predetermined nipping pressure is not generated between the first conveyance roller 661 and the second conveyance roller 662.

However, as shown in FIG. 8, when the main body cover 101 is closed, a pressing force F by the compression coil spring 684 is applied to the cover member 68. Thus, an adequate nipping pressure is generated between the first conveyance roller 661 and the second conveyance roller 662.

As described above, in the image forming apparatus 1 of this embodiment, the torsion coil spring 69 generates only an urging force sufficient for returning the cover member 68 from the opening posture to the intermediate posture. Accordingly, there is no likelihood that the cover member 68 may vigorously collide against the housing 600 by an urging force applied to the cover member 68 for returning the cover member 68 to the original posture. Thus, there is avoided generation of impact noise when the cover member 68 is closed, and damage of the cover member 68 or the housing 600. While avoiding the above drawback, a nipping pressure between the first conveyance roller 661 and the second conveyance roller 662 constituting the conveyance roller pair 66 is secured by the urging force of the compression coil spring 684 when the cover member 68 is in the closing posture.

The aforementioned arrangement also contributes to stable generation of a nipping pressure of the conveyance roller pair 66. Specifically, if the function of generating a nipping pressure of the conveyance roller pair 66 is imparted to a spring (corresponding to the torsion coil spring 69 in the embodiment) which is urged in such a direction as to close the cover member 68, as in the conventional arrangement, it may be difficult to finely adjust the nipping pressure, and the nipping pressure may be unstable in view of a requirement the urging force of the spring should be set large. Consequently, a sheet conveying force by the conveyance roller pair 66 may vary each time the cover member 68 is opened and closed. The image forming apparatus 1 of this embodiment eliminates such a drawback.

Further, the timing at which the main body cover 101 is brought to a closed state with respect to the apparatus body 10 is a timing at which a predetermined pressing force is given to the movable pin 685 for generating an urging force in the compression coil spring 684. Normally, in the case where a sheet has jammed in the fixing section 60, the user opens the main body cover 101, and then, the cover member 68 of the fixing section 60 is opened. Then, after the jammed sheet has been removed, the cover member 68 is brought to a closing posture, and in response to closing of the main body cover 101, the second conveyance roller 662 is brought to a state that the second conveyance roller 662 is pressingly contacted with the first conveyance roller 661. Thus, the user is allowed to generate a nipping pressure in the conveyance roller pair 66 by closing the main body cover 101 without specifically intending to generate a nipping pressure.

(1) In the foregoing, a preferred embodiment of the present disclosure has been described. The present disclosure is not limited to the above arrangement, but may be modified as follows.

(2) In the embodiment, the opening 600H of the housing 600 is formed by partially cutting away the top surface 600U and the right side surface 600R of the housing 600, so that the cover member 68 covers the opening 600H. This is a preferred example, in the case where the fixing section 60 of the embodiment is disposed in the main conveyance path 50A extending in a vertical direction. The arranged position of the opening 600H and the opening direction of the cover member 68 may be optionally selected depending on the configuration of the image forming apparatus.

(3) In the embodiment, the inductive heating type fixing section 60 provided with the inductive heating unit 65 has been exemplified as the fixing device. It is needless to say that the heating source of the fixing section 60 may be a halogen heater, a resistance heating member, or the like.

(4) In the embodiment, when the main body cover 101 is closed with respect to the apparatus body 10, the movable pin 685 is pressed against the inner surface of the body cover 101, and the compression coil spring 684 generates an urging force. Alternatively, the compression coil spring 684 may be configured to generate an urging force by user's manipulation of a lever or a like member.

As described above, the present disclosure provides a fixing device having a cover member, which is advantageous in stably generating a nipping pressure of a conveyance roller pair while preventing generation of impact noise when the cover member is closed.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A fixing device, comprising:

a first roller and a second roller that form a fixing nip portion for applying a fixing processing to a sheet;

a housing that accommodates the first roller and the second roller, the housing having an opening through which the fixing nip portion is exposed;

a cover member pivotally mounted on the housing, the cover member being operable to change a posture thereof between a closing posture where the opening is covered, and an opening posture where the opening is opened;

a first conveyance roller rotatably supported on the housing for conveying the sheet that has passed the fixing nip portion;

a second conveyance roller rotatably supported on the cover member, the second conveyance roller being pressingly contacted with the first conveyance roller when the cover member is in the closing posture;

a first urging member that applies an urging force to the cover member in the opening posture for returning the cover member from the opening posture to an intermediate posture between the opening posture and the closing posture; and a second urging member that applies an urging force to the second conveyance roller for pressingly contacting the second conveyance roller with the first conveyance roller when the cover member is in the closing posture, wherein the intermediate posture is a posture where the urging force of the first urging member is applied minimally to the cover member.

2. The fixing device according to claim 1, wherein the housing has a generally rectangular shape in cross section, the opening is formed by partially cutting away a top surface and one side surface of the housing at a position corresponding to an upper corner portion of the housing, and the cover member is a member which covers the cutaway portion of the top surface and the one side surface of the housing.

3. The fixing device according to claim 2, wherein the housing includes a support portion on the one side surface thereof, the cover member includes an arm member having a pivot portion at one end thereof, and a cover body continuing from another end of the arm member for holding the second conveyance roller, the arm member being pivotally supported on the support portion about the pivot portion, the arm member is operable to stand upright along the one side surface of the housing when the cover member is in the closing posture, and is operable to be inclined in such a manner as to project outwardly from the one side surface of the housing when the cover member is in the opening posture, and the intermediate posture is a posture that a centroid of the cover member is located outwardly from a position immediately above the pivot portion.

4. The fixing device according to claim 3, wherein the first urging member is a torsion coil spring which is inserted in the pivot portion of the arm member.

5. The fixing device according to claim 1, further comprising:

a pressed member which is engaged with the second urging member, wherein the second urging member applies the urging force to the second conveyance roller when a predetermined pressing force is applied to the pressed member.

6. The fixing device according to claim 5, wherein the pressed member is a movable pin which is mounted on the cover member to be slidably movable, and the second urging member is a compression coil spring which is mounted in the movable pin in engagement therewith.

7. An image forming apparatus, comprising:

an image forming section that forms a toner image onto a sheet, a fixing device that applies a processing of fixing the toner image to the sheet;

an apparatus body including a casing structure, and for accommodating the image forming section and the fixing device; and a main body cover that is mounted on the apparatus body to be openable and closable, wherein the fixing device includes:

a first roller and a second roller that form a fixing nip portion for applying a fixing processing to a sheet;

a housing that accommodates the first roller and the second roller, the housing having an opening through which the fixing nip portion is exposed;

a cover member pivotally mounted on the housing, the cover member being operable to change a posture thereof between a closing posture where the opening is covered, and an opening posture where the opening is opened;

a first conveyance roller rotatably supported on the housing for conveying the sheet that has passed the fixing nip portion;

a second conveyance roller rotatably supported on the cover member, the second conveyance roller being pressingly contacted with the first conveyance roller when the cover member is in the closing posture;

a first urging member that applies an urging force to the cover member in the opening posture for returning the cover member from the opening posture to an intermediate posture between the opening posture and the closing posture;

a second urging member that applies an urging force to the second conveyance roller for pressingly contacting the second conveyance roller with the first conveyance roller when the cover member is in the closing posture; and a pressed member that is engaged with the second urging member, wherein the fixing device and the main body cover are disposed on a side of one side surface of the apparatus body, the pressed member is pressed by the main body cover when the cover member is in the closing posture, the second urging member applies the urging force to the second conveyance roller in response to application of a predetermined pressing force to the pressed member, and the intermediate posture is a posture where the urging force of the first urging member is applied minimally to the cover member.

8. The image forming apparatus according to claim 7, wherein the housing has a generally rectangular shape in cross section, the opening is formed by partially cutting away a top surface and one side surface of the housing at a position corresponding to an upper corner portion of the housing, and the cover member is a member which covers the cutaway portion of the top surface and the one side surface of the housing.

9. The image forming apparatus according to claim 8, wherein the housing includes a support portion on the one side surface thereof, the cover member includes an arm member having a pivot portion at one end thereof, and a cover body continuing from another end of the arm member for holding the second conveyance roller, the arm member being pivotally supported on the support portion about the pivot portion, the arm member is operable to stand upright along the one side surface of the housing when the cover member is in the closing posture, and is operable to be inclined in such a manner as to project outwardly from the one side surface of the housing when the cover member is in the opening posture, and the intermediate posture is a posture that a centroid of the cover member is located outwardly from a position immediately above the pivot portion.

10. The image forming apparatus according to claim 9, wherein the first urging member is a torsion coil spring which is inserted in the pivot portion of the arm member.

11. The image forming apparatus according to claim 7, wherein the pressed member is a movable pin which is mounted on the cover member to be slidably movable, and the second urging member is a compression coil spring which is mounted in the movable pin in engagement therewith.

12. A fixing device, comprising:

a first roller and a second roller which form a fixing nip portion for applying a fixing processing to a sheet;

a housing that accommodates the first roller and the second roller, the housing having a generally rectangular shape in cross section and having an opening through which the fixing nip portion is exposed, the opening being formed by partially cutting away a top surface and one side surface of the housing at a position corresponding to an upper corner portion of the housing, the housing further including a support portion on the one side surface thereof;

a cover member pivotally mounted on the housing, the cover member being operable to change a posture thereof between a closing posture where the cover member covers the cutaway portion of the top surface and the one side surface of the housing and an opening posture where the opening is opened, the cover member including an arm member having a pivot portion at one end thereof and a cover body continuing from another end thereof, the pivot portion of the arm member being pivotally supported on the support portion, the arm member being operable to stand upright along the one side surface of the housing when the cover member is in the closing posture, and being operable to be inclined to project out from the one side surface of the housing when the cover member is in the opening posture;

a first conveyance roller supported rotatably on the housing and conveying the sheet that has passed the fixing nip portion;

a second conveyance roller supported rotatably on the cover body of the cover member, the second conveyance roller being pressingly contacted with the first conveyance roller when the cover member is in the closing posture;

a first urging member that applies an urging force to the cover member in the opening posture for returning the cover member from the opening posture to an intermediate posture between the opening posture and the closing posture; and a second urging member which applies an urging force to the second conveyance roller so that the second conveyance roller is pressingly contacted with the first conveyance roller when the cover member is in the closing posture, wherein the intermediate posture is a posture where a centroid of the cover member is located outwardly from a position immediately above the pivot portion.

13. A fixing device, comprising:

a first roller and a second roller which form a fixing nip portion for applying a fixing processing to a sheet;

a housing which accommodates the first roller and the second roller, the housing having an opening through which the fixing nip portion is exposed;

a cover member pivotally mounted on the housing, the cover member being operable to change a posture thereof between a closing posture that the opening is covered, and an opening posture that the opening is opened;

a first conveyance roller supported rotatably on the housing and conveying the sheet that has passed the fixing nip portion;

a second conveyance roller supported rotatably on the cover member, the second conveyance roller being pressingly contacted with the first conveyance roller when the cover member is in the closing posture;

a movable pin mounted on the cover member to be slidably movable;

a first urging member that applies an urging force to the cover member in the opening posture for returning the cover member from the opening posture to an intermediate posture between the opening posture and the closing posture; and a second urging member that applies an urging force to the second conveyance roller so that the second conveyance roller is pressingly contacted with the first conveyance roller when the cover member is in the closing posture, the second urging member being a coil spring mounted on the movable pin and engaged therewith, the coil spring applying the urging force to the second conveyance roller when a predetermined pressing force is applied to the movable pin.

* * * * *